US005791955A

United States Patent [19]

Rinck

[11] Patent Number: 5,791,955

[45] Date of Patent: Aug. 11, 1998

[54] COVER FOR BOAT PROPULSION UNITS

[76] Inventor: Davor Rinck, Ohlsdorfer Strasse 62, D-22297 Hamburg, Germany

[21] Appl. No.: 656,241

[22] PCT Filed: Nov. 23, 1994

[86] PCT No.: PCT/DE94/01376

§ 371 Date: May 24, 1996

§ 102(e) Date: May 24, 1996

[87] PCT Pub. No.: WO95/14606

PCT Pub. Date: Jun. 1, 1995

[30] Foreign Application Priority Data

Nov. 25, 1993 [DE] Germany ..... 43 40 131.7

[51] Int. Cl.[6] ..... B63H 20/36

[52] U.S. Cl. ..... 440/113; 416/247 A; 440/900

[58] Field of Search ..... 440/113, 71, 900; 416/247 A; 70/58; 206/317

[56] References Cited

U.S. PATENT DOCUMENTS

| | | | |
|---|---|---|---|
| 2,475,135 | 7/1949 | Haven . | |
| 2,822,183 | 2/1958 | Montgomery . | |
| 2,984,096 | 5/1961 | Putman et al. . | |
| 5,072,683 | 12/1991 | Colonna . | |
| 5,113,791 | 5/1992 | Rottschafer . | |
| 5,148,777 | 9/1992 | Brockhurst . | |
| 5,172,575 | 12/1992 | Fisher | 206/317 |
| 5,469,721 | 11/1995 | Pyle | 416/247 A |

OTHER PUBLICATIONS

"Stropp Für Die Backstagen", *Yacht*, Jan. 1990, p. 95.

*Primary Examiner*—Sherman Basinger
*Attorney, Agent, or Firm*—Harness, Dickey & Pierce, P.L.C.

[57] ABSTRACT

The cover is used for boat drive units, at least portions of which are disposed outside the hull of a boat. At least two housing shells are provided, which can be placed in a form-fitting manner on the part of the boat drive unit which is outside the hull of the boat. The housing shells can be connected to each other. The interior contour is formed by a foamed material, which is supported by the walls of the housing shells.

17 Claims, 2 Drawing Sheets

COVER FOR BOAT PROPULSION UNITS

BACKGROUND AND SUMMARY OF THE INVENTION

The invention concerns a cover for boat propulsion units, which are, at least to some extent, disposed outside the hull of the boat.

Boats, which are equipped with motors, are frequently transported on trailers, which are pulled by motor vehicles. In the case of boats, which are equipped with Z-drives (inboard/outboard drives), as well as in the case of boats, which are equipped with outboard motors, essential parts of the propulsion unit are located outside the hull of the boat and thus are subject to the risk of being damaged. Furthermore, these parts constitute risks to persons in cases of accidents. Even in the case of a normal transport, there is concern, that because of the effects of the weather, a contamination of these very valuable components can take place, which will reduce their ability to function. It is, therefore, known to pull a sack—which can be appropriately secured with strings in order to keep it from inadvertently being loosened—over the outwardly located parts of the drive unit, while it is being transported. However, such a packaging method has the disadvantage, that, on the one hand, it has only a relatively limited protective ability, and, on the other hand, the risk that a theft of parts of the drive unit may occur likewise cannot be reduced, because this kind of packaging involving the use of a sack, can easily be undone.

It is, therefore, the object of the present invention, to construct a cover of the initially stated kind in such a manner, that its usability can be improved.

This objective is achieved according to the invention in such a manner that at least two housing shells are provided, having an interior contour which fits the shape of that part of the boat propulsion unit, which is disposed outside the hull of the boat, and upon which the shells, which can be connected to each other, can be placed, and where the interior contour is formed by a foamed material, which is supported by the walls of the housing shells.

By means of the housing shells, to which the foamed material has been added, a cover of high mechanical strength for covering the parts of the drive unit, which are located on the outside, is being provided. It can be applied in the case of Z-drive units, which are, for example, available under the trade name of "Mercruiser", or for outboard motors, which are available under the name of "Mercury". It has been considered, in particular, to connect the housing shells to each other by mechanically strong components. In this manner, the protection against theft is significantly increased, because due to the form-fitting adaptation of the cover to the outside portion of the boat propulsion unit, the cover can no longer simply be pulled off. By the use of the foamed material on the inside of the housing shells, a sufficiently pliable coverage of the drive unit parts is ensured, which avoids damage to the covered parts even when there is shaking and impact from the outside.

In order to simplify their handling, it is proposed that the housing shells be joined by a hinge.

The protection against theft can be increased by connecting the housing shells to each other with a safety bolt, which, while closely fitting them, reaches behind a contour portion of the drive unit of the boat.

In order to improve the aerodynamic properties it is proposed that a rear part of the cover be disposed essentially vertically and that a connecting region, which produces a transition zone from the rear surface to the top surface, be disposed at an essentially oblique angle to the horizontal.

A typical application consists in having the foamed material generate an inner contour for a drive unit of a boat incorporating of a Z-drive.

A further area of application is opened up due to the fact that the foamed material generates an inner contour for a boat drive unit, which consists of an outboard motor.

In order to generate a high level of mechanical stability, it is proposed that the walls of the housing shells be made from a glass-fiber reinforced plastic.

An increase of the adaptability is provided by means of a clearance free space, which is disposed in the region of the foamed material for receiving the propeller.

In order to further increase the protection against theft it is proposed, that an outer contour of the housing shells be adapted in a form-fitting manner to the outer contour of the boat drive unit.

A connection between the housing shells capable of sustaining high loads, which, however, can easily be separated by authorized persons, is provided by having the housing shells enclosed by a profiled cover, which serves as the support member for the locking device by means of which the two housing shells are connected.

A shape, which offers good resistance to the effects of the weather, is provided by having the housing shells form a cover, which is essentially tear-shaped in the vertical direction, while an area, which terminates in a point in the vertically downward direction, is oriented toward the bottom, and a hinge is located in this area.

BRIEF DESCRIPTION OF THE DRAWINGS

In the drawing, three embodiments of the invention are shown schematically. The following is shown.

DESCRIPTION OF THE PREFERRED EMBODIMENT

Figure 1:
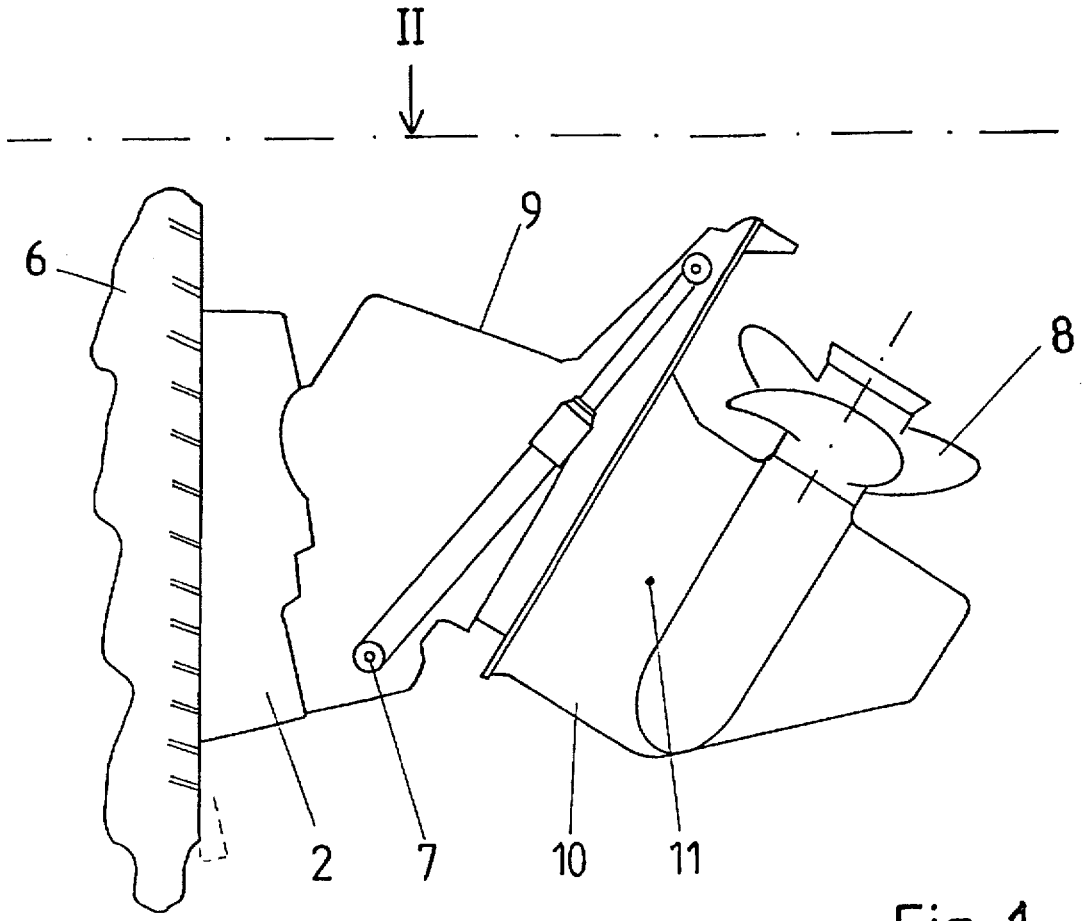
FIG. 1 a side view of a Z-drive unit which has been tilted up in the region of the hull of the boat, FIG. 2 a top view in accordance with the line of vision II in FIG. 1
Figure 2:
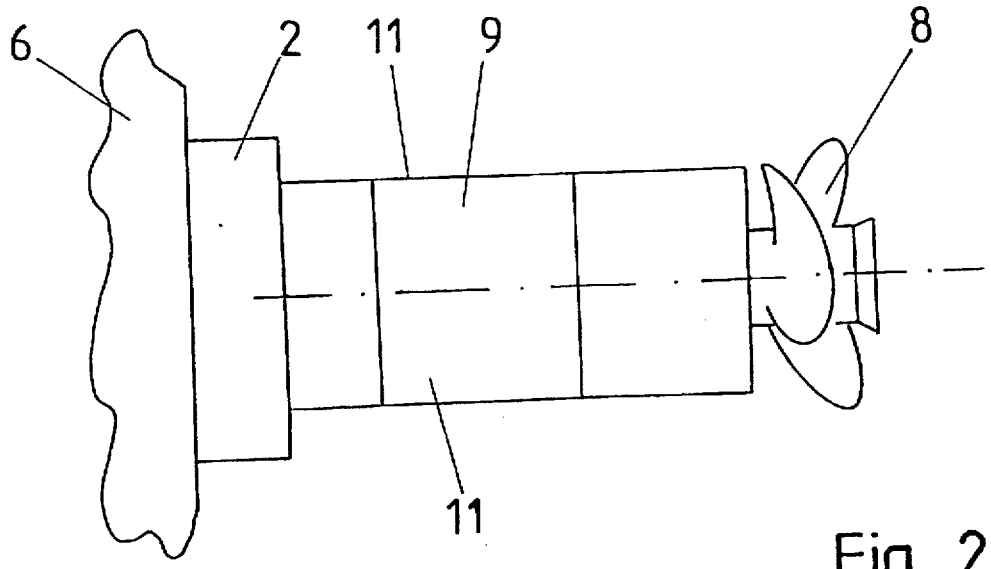

A cover (1) for a boat drive unit (2) consists essentially of housing shells (3), which are provided with a foamed material (5) in the region of an interior space (4). The foamed material (5) has an inner contour, which is adapted to the outer contour of the boat drive unit (2).

In the embodiment according to FIG. 1, the boat drive unit (2), which takes the form of a Z-drive, is disposed in the region of a boat hull (6). The Z-drive unit can be pivoted around a joint (7). As a means of releasing the propulsive force, a screw or propeller (8) is provided. In the horizontal direction, the boat drive unit (2) contains a profiled contour in the region of its top (9) as well as in the region of its bottom (10). The same is true for its flank regions (11). By means of a form-fitting adaptation of the foamed material (5) to the outer contour of the boat drive unit (2), it is possible to exclude the risk that the cover (1) can be pulled from the boat drive unit (2), after the housing shells (3) are joined to each other.

Figure 3:
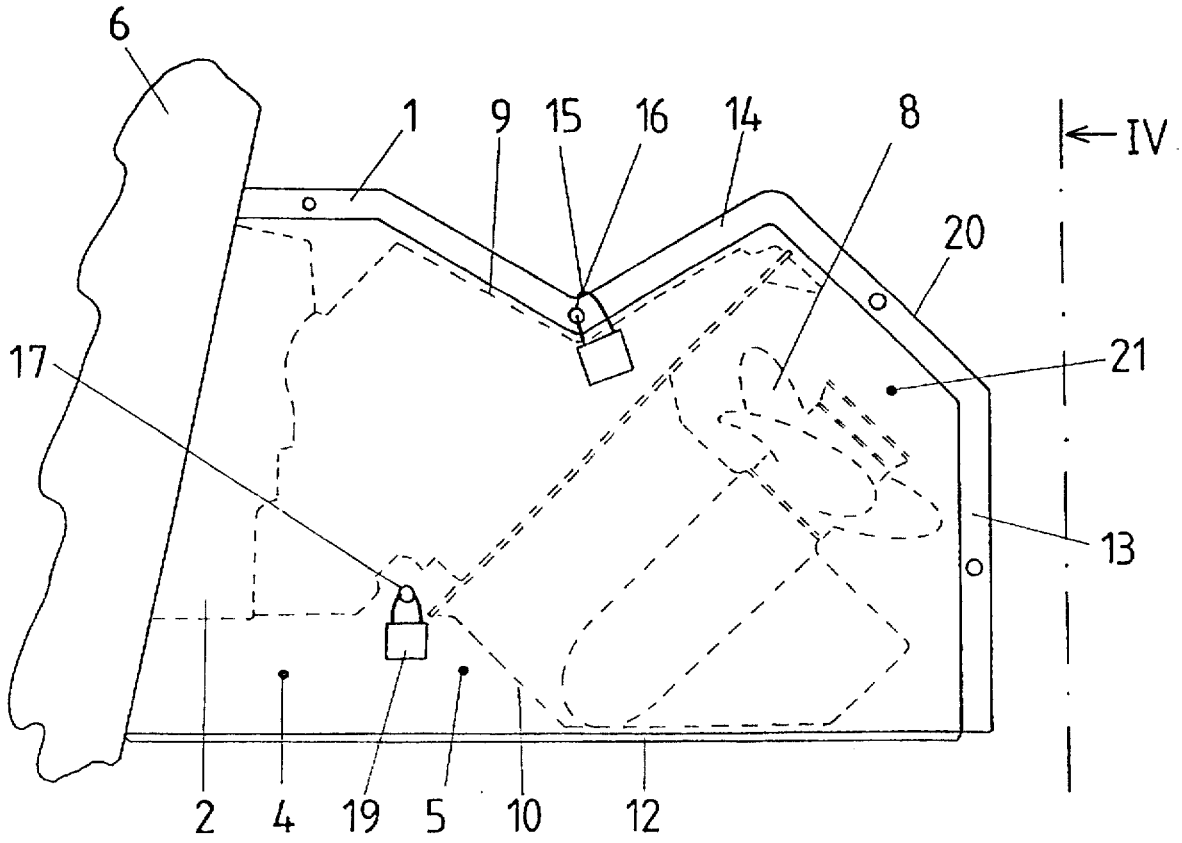
FIG. 3 a side view of a cover with a Z-drive unit shown by broken lines.
Figure 4:
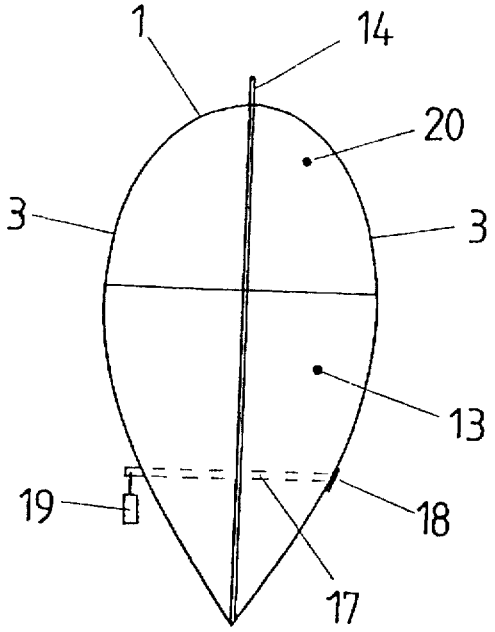
FIG. 4 a side view in accordance with the line of vision IV in FIG. 3.

In accordance with the embodiment in FIG. 3, it is contemplated to connect the two housing halves (3) to each other by means of a hinge (12), which extends along the bottom (10). The cover (1) may be formed essentially linearly along the bottom (10) with regard to its outer contour. Along the top (9) as well as in the region of its rear (13), the housing shells (3) have a cover profile (14) which includes generally outwardly extending abutting peripheral flanges. The cover profile (14) increases the stability. It is contemplated, in particular, to place a lock (15) in the region of the top (9). The lock (15) can, for example, take the form of a padlock, which penetrates the housing profile flungs in the region of a recess (16).

A further locking action can be implemented by disposing a safety bolt (17) in the region of the bottom (10), which connects the housing shells (3) to each other. The safety bolt (17) can be provided with a bolt head (18) in the region of one end, and it contains a through hole in the region of another end, into which a lock (19) can be inserted. The lock (19) can also take the form of a padlock.

The safety bolt (17) is preferably disposed in a region, where it reaches behind a protrusion of the boat drive unit (2). By this means, additional protection against theft can be provided. The ability to pull off the cover (1) when the housing shells (3) are in their closed condition will further be supported by a V-shaped profile in the region of the top (9), which is made possible by virtue of the adaptation of the contour to the boat drive unit (2). In order to improve the aerodynamic properties it is contemplated to place the region where the rear (13) is connected with the top (9) in an oblique orientation. By this means, a favorable air flow pattern can be achieved. The rear (13) is preferably vertically disposed and has a flattened shape. This has the particular advantage that a surface is being provided, which can serve as a support surface for advertising material.

In order to facilitate an adaptability to different screws (8), it is contemplated to provide the interior space (4) with foamed material (5) in such a manner that it does not completely envelop the boat drive unit (2), but leaves a clearance space (21) in the region of the screw (8).

The housing shells (3) can be made from a glass-fiber reinforced plastic. The foamed material (5) can, for example, be made of polyurethane foam. The forming of the foamed material (5) is achieved in such a manner that relatively small clearances between it and the contour of the boat drive unit (2) are generated. This facilitates, on the one hand, a simple way of mounting the housing shells (3), and on the other hand, a reliable seating action is ensured, and the possibility of rattling or vibration of the cover (1) is suppressed.

I claim:

1. A cover for a boat drive unit, which drive unit is disposed at least to some extent outside the hull of a boat, characterized in that at least two housing shells (3) are provided having an interior contour which generally conforms to the shape of that part of the boat drive unit (2), which is disposed outside the hull (6) of the boat, a hinge interconnecting said shells, said shells being interconnected and adapted to substantially removably enclose that portion of said drive unit disposed outside of said hull, said shells including a foam material on the interior thereof and adapted to engage said drive unit, and each of said shells include a flange portion extending around at least a portion of the periphery thereof, said flange portions being adapted to receive a lock for connecting said housing shells.

2. A cover for a boat drive unit, which drive unit is disposed at least to some extent outside the hull of a boat, characterized in that at least two housing shells (3) are provided having an interior contour which generally conforms to the shape of that part of the boat drive unit (2), which is disposed outside the hull (6) of the boat, said shells being interconnected and adapted to substantially removably enclose that portion of said drive unit disposed outside of said hull, said shells including a foam material on the interior thereof and adapted to engage said drive unit, said boat drive unit having a predetermined contour and said housing shells (3) are connected to each other in a closed position by means of a safety bolt (17), which reaches behind the contour of the boat drive unit (2) in a form-fitting manner.

3. A cover according to claim 1, characterized in that a rear edge portion (13) of the cover (1) is essentially vertically disposed and a connection edge portion (20), which forms a transition zone from said rear edge portion (13) to a top edge portion (9), is essentially obliquely disposed relative to the horizontal.

4. A cover according to claim 3, characterized in that the walls of the housing shells (3) are made of a glass-fiber reinforced plastic.

5. A cover according to claim 4, wherein said drive unit includes a screw and further characterized in that a free space (21) for receiving the screw (8) is formed in the foamed material (5).

6. A cover according to claim 5, characterized in that an outer contour of the housing shells (3) is adapted to the outer contour of the boat drive unit (2) in a generally form-fitting manner.

7. A cover according to claim 5, characterized in that the housing shells (3) are forming the cover (1) in an essentially tear-shaped form in the vertical direction, while a portion which terminates in a sharp point is oriented toward the bottom in a vertical direction, and that a hinge (12) is placed in this region.

8. A cover according to claim 2, characterized in that the foamed material (5) forms an interior contour for a boat drive unit (2), which takes the form of a Z-drive unit.

9. A cover according to claim 8, characterized in that the housing shells (3) are forming the cover (1) in an essentially tear-shaped form in the vertical direction, while a portion which terminates in a sharp point is oriented toward the bottom in a vertical direction, and that a hinge (12) is placed in this region.

10. A cover according to claim 8, wherein said drive unit includes a screw and further characterized in that a free space (21) for receiving the screw (8) is formed in the foamed material (5).

11. A cover according to claim 1, characterized in that the foamed material (5) forms an interior contour for a boat drive unit (2), which takes the form of a Z-drive unit.

12. A cover according to claim 1, characterized in that the foamed material (5) forms an interior contour for a boat drive unit (2), which takes the form of an outboard drive unit.

13. A cover according to claim 1, characterized in that the walls of the housing shells (3) are made of a glass-fiber reinforced plastic.

14. A cover according to claim 1, wherein said drive unit includes a screw and further characterized in that a free space (21) for receiving the screw (8) is formed in the foamed material (5).

15. A cover according to claim 1, characterized in that an outer contour of the housing shells (3) is adapted to the outer contour of the boat drive unit (2) in a generally form-fitting manner.

16. A cover for a boat drive unit, which drive unit is disposed at least to some extent outside the hull of a boat, characterized in that at least two housing shells (3) are provided having an interior contour which generally conforms to the shape of that part of the boat drive unit (2), which is disposed outside the hull (6) of the boat, said shells being interconnected and adapted to substantially removably enclose that portion of said drive unit disposed outside of said hull, said shells including a foam material on the interior thereof and adapted to engage said drive unit, said housing shells (3) are forming the cover (1) in an essentially tear-shaped form in the vertical direction, while a portion which terminates in a sharp point is oriented toward the bottom in a vertical direction, and that a hinge (12) is placed in this region.

17. A cover for a boat drive unit, said drive unit including a portion disposed outside of the hull of a boat, said cover comprising:

first and second outer housing shells, said shells being adapted to be removably secured together to define a substantially enclosed interior space adapted to accommodate said portion of said drive unit; and a foam material filling a portion of said interior space and adapted to support said cover on said portion of said drive unit, said foam material forming an interior contour for a boat drive unit, which takes the form of a Z drive unit.

* * * * *